United States Patent [19]

Sharon et al.

[11] Patent Number: 4,832,213

[45] Date of Patent: May 23, 1989

[54] BABY BOTTLE

[75] Inventors: Arie Sharon, 1014 Wake Dr., Richardson, Tex. 75081; Alexander Theodore, 1113 N. County Club Rd., Marge, Okla. 74403

[73] Assignees: Arie Sharon, Dallas, Tex.; Alexander Theodore, Muskogee, Okla.; Edward R. Melzi, Garland, Tex.

[21] Appl. No.: 80,887

[22] Filed: Aug. 3, 1987

[51] Int. Cl.[4] ..... A61J 9/00

[52] U.S. Cl. ..... 215/11.1; 215/1 R; 215/1 C; D9/373; D9/375

[58] Field of Search ..... 215/11.1, 1 R, 1 C; D9/367, 372, 373, 374, 375; 229/1.5 B

[56] References Cited

U.S. PATENT DOCUMENTS

| | | | |
|---|---|---|---|
| D. 203,950 | 3/1966 | Swayze | D9/373 |
| D. 220,249 | 3/1971 | Gould | D9/375 |
| D. 249,076 | 8/1978 | Meeker et al. | 215/1 R |
| D. 288,528 | 3/1987 | Parad | D9/373 |
| 460,857 | 10/1891 | Flodin | 215/11.1 |
| 2,514,744 | 7/1950 | Cipyak | 215/11.1 |
| 2,831,596 | 4/1958 | Eyles | 215/11.1 |
| 3,145,867 | 8/1964 | Roberts et al. | 215/11.1 |
| 4,570,808 | 2/1986 | Campbell et al. | 215/11.1 |

FOREIGN PATENT DOCUMENTS

| | | | |
|---|---|---|---|
| 291449 | 12/1931 | Italy | 215/11.1 |

*Primary Examiner*—David T. Fidei
*Attorney, Agent, or Firm*—Howard R. Greenberg

[57] ABSTRACT

A baby bottle employs a curved shape along its length and a beveled top to facilitate drinking therefrom.

5 Claims, 1 Drawing Sheet

BABY BOTTLE

BACKGROUND OF THE INVENTION

Although there are numerous baby bottles on the market, such as the one described in U.S. Pat. No. 4,570,808, their designs are more concerned with convenience of use than health. Specifically, when a sitting baby drinks from any commercial baby bottle, there is a tendency for the baby to shift its head back to facilitate drinking. With the head in this position, there is a risk of ear infections resulting from liquid possibly entering the eustachian tube.

It is thus an object of the present invention to provide a new and improved baby bottle to facilitate drinking whether the baby is in a reclining or sitting position.

It is a further object of the present invention to provide such a new and improved baby bottle which is convenient for the baby to use without the need for attention by another.

BRIEF DESCRIPTION OF THE INVENTION

The baby bottle of the invention preferably employs a curved shape along its length and a beveled top such that when used by a baby, even in a sitting position, the bottle arches upward towards the baby's head. The more vertical positioning of the bottle than obtainable with conventional baby bottles significantly improves gravity flow, thus eliminating or at least diminishing the need for the baby to tilt its head to retrieve liquid from the bottle. Tapering of the bottle from its bottom to its top affords adequate capacity for one feeding while providing a small enough circumference near the top to permit the baby to grip the bottle and feed itself without the need for being attended to by another.

DETAILED DESCRIPTION OF THE PREFERRED EMBODIMENT

Figure 1:
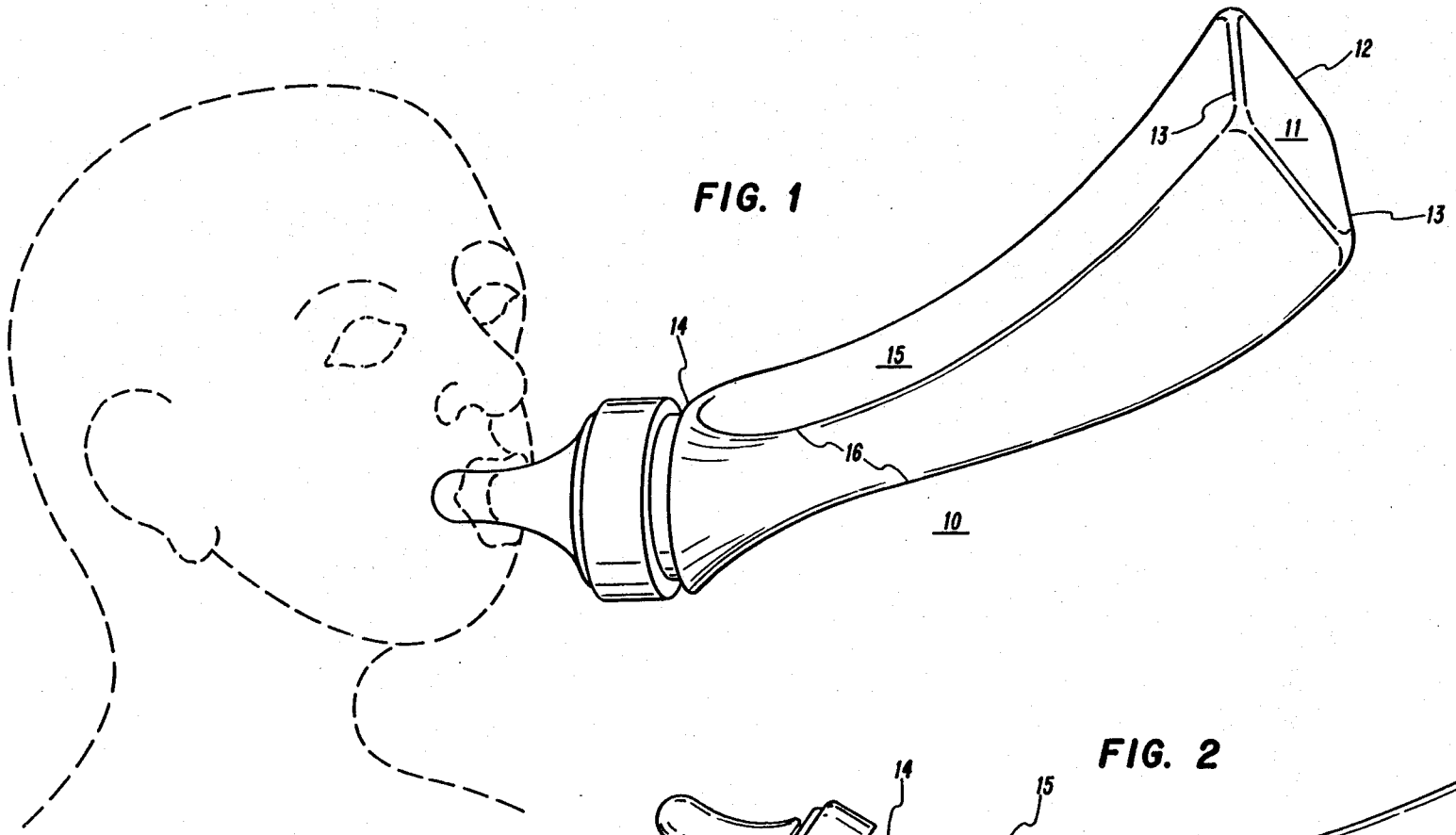
FIG. 1 is an isometric view of the preferred embodiment of the invention.
Figure 2:
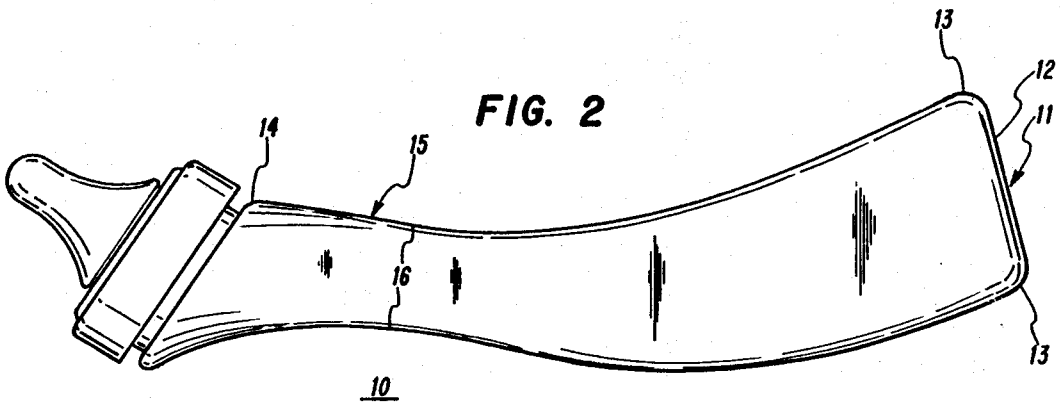
FIG. 2 is a side profile of the bottle depicted in FIG. 1.

As shown in FIGS. 1 and 2, the baby bottle 10, which can be formed from any desired conventional material such as glass or plastic, preferably has a generally rectangular cross-sectional area 11 and a curved shape along its length which tapers from its bottom 12 towards its top 14. The tapered portion of the bottle 10 proximate the top 14, in contrast to the bottom 12 permits a baby to easily wrap its hands around the bottle for self feeding while the wider bottom 12 affords sufficient capacity for a single feeding. Gripping of the bottle is further facilitated by indenting a portion of the two planes formed by the longer sides 13 of the cross-sectional area 11, as shown in the vicinity 15.

The top 14 is beveled so that when a baby drinks from the bottle 10 even in a sitting position, the bottle is positioned in a substantially vertical direction to facilitate drinking through gravity flow without the need for the baby to tilt its head back. This eliminates the risk of ear infections which might otherwise arise from liquid entering into the baby's eustachian tube.

The rectangular cross-sectional area 11 and curved shape of the bottle 10 provide the additional advantage of preventing the bottle 10 from rolling when placed lengthwise on a horizontal surface.

To further facilitate the retrieval of liquid from the bottle, the curved planes of the bottle formed by the longer sides 13 of the cross-sectional area 11 have an inflection point 16 near the top 14 of the bottle above which the bottle 10 shape flares out.

As the foregoing demonstrates, the baby bottle disclosed herein affords a convenient way for a baby to drink liquid without the intervention of another and without the risk of ear infections whether in a reclining or sitting position. Since various modifications to the foregoing detailed description which would not depart from the scope and spirit of the invention are undoubtedly possible, the preferred embodiment described herein is intended to be merely exemplary and not restrictive of the invention as claimed hereinbelow.

What is claimed is:

1. A baby bottle having a curved shape along substantially its entire length, a beveled top such that when drunk from, the bottle arches upward towards the drinker's head and a rectangular cross-sectional area over at least a portion of its body beginning at the bottom of the bottle and in which the planes of the two longer sides of said cross-sectional area have similarly curved contours.

2. The baby bottle of claim 1 wherein the contour of said two planes inflects near the top of the bottle.

3. The baby bottle of claim 2 wherein the length of the two shorter sides of the rectangular cross-section continuously diminishes from the base of the bottle to said inflection.

4. The baby bottle of claim 3 wherein said two planes diverge from said inflection to the top of the bottle.

5. The baby bottle of claim 4 wherein the bottle has a partially indented circumference along at least a portion of its length to facilitate gripping.

* * * * *